US006499809B1

(12) United States Patent
O'Konek

(10) Patent No.: US 6,499,809 B1
(45) Date of Patent: Dec. 31, 2002

(54) APPARATUS FOR CUTTING RECESSES IN PAVEMENT

(75) Inventor: Dusten C. O'Konek, South Haven, MN (US)

(73) Assignee: Snapper Machinery, Inc., Maple Grove, MN (US)

( * ) Notice: Subject to any disclaimer, the term of this patent is extended or adjusted under 35 U.S.C. 154(b) by 0 days.

(21) Appl. No.: 09/116,356

(22) Filed: Jul. 16, 1998

Related U.S. Application Data

(63) Continuation-in-part of application No. 08/940,433, filed on Sep. 30, 1997, now abandoned.

(51) Int. Cl.[7] ..... E01C 23/09

(52) U.S. Cl. ..... 299/39.6; 404/94

(58) Field of Search ..... 299/36.1, 37.1, 299/39.1, 39.4, 39.5, 39.6; 404/90, 91, 94

(56) References Cited

U.S. PATENT DOCUMENTS

| | | | |
|---|---|---|---|
| 2,574,090 | A | 11/1951 | Dofsen |
| 2,826,128 | A | 3/1958 | Summers |
| 3,094,046 | A | 6/1963 | Zipelius |
| 3,407,005 | A | 10/1968 | Simms et al. |
| 3,529,517 | A | 9/1970 | Liddle et al. |
| 3,612,611 | A | 10/1971 | Ellis |
| 3,788,704 | A | 1/1974 | Staab |
| 3,801,211 | A | 4/1974 | Perkins |
| 3,868,146 | A | 2/1975 | Ellis |
| 3,874,806 | A | 4/1975 | Grist et al. |
| 3,929,377 | A | 12/1975 | Weaver et al. |
| 4,174,184 | A | 11/1979 | Heenan |
| 4,516,808 | A | 5/1985 | Staab et al. |
| 4,575,278 | A | 3/1986 | Whitney |
| 4,701,069 | A | 10/1987 | Whitney |
| 4,900,094 | A | 2/1990 | Sergeant |
| 4,986,604 | A | 1/1991 | Meister |
| 5,078,540 | A | 1/1992 | Jakob et al. |
| 5,083,839 | A | 1/1992 | Younger |
| 5,092,658 | A | 3/1992 | Smith |
| 5,094,565 | A | 3/1992 | Johnson |
| 5,114,269 | A | 5/1992 | Shepherd |
| 5,297,894 | A | 3/1994 | Yenick |
| 5,354,146 | A | 10/1994 | O'Konek |
| 5,391,017 | A | 2/1995 | Thomas et al. |
| 5,484,228 | A | 1/1996 | Thomas et al. |
| 5,582,490 | A | 12/1996 | Murray |
| 5,607,255 | A | 3/1997 | Thomas et al. |
| 5,676,490 | A | 10/1997 | Nelson |

FOREIGN PATENT DOCUMENTS

| | | |
|---|---|---|
| DE | 2 209 743 | 9/1973 |
| DE | 32 00 862 A1 | 7/1983 |

OTHER PUBLICATIONS

International Grooving and Grinding Association brochure entitled, "Grooved Runways are Safer . . . Ground Runways are Easier on Aircraft".

International Grooving and Grinding Association brochure entitled, "Grooving & Grinding are Cost Effective Ways to Restore Pavement Surfaces".

Target® Pavement Grinder brochure.

Target Safetrac® Systems brochure.

Cushion Cut PC–5000 brochure.

Affidavit of Glenn Shed, executed Feb. 27, 2002 (2 pages).

"Devices to Prevent Run–Off–Road Accidents," California State Department of Transportation, Sacramento Transportation Lab, U.S. Department of Commerce, National Technical Information Service, 61 pages (Feb. 1976).

Statement of Jeff Arnswald, executed Mar. 5, 2002 (2 pages).

*Primary Examiner*—David Bagnell
*Assistant Examiner*—John Kreck
(74) *Attorney, Agent, or Firm*—Merchant & Gould P.C.

(57) ABSTRACT

A pavement grinding apparatus includes a cutting device with a frame supporting the cutting device from above. Transversely extending parallel shafts have an offset connection imparting cyclical up and down motion to the cutting carriage and rotating arbor. A first motor drives the arbor while a second motor drives cutting carriage wheels and the support shafts. The carriage and arbor move backward relative to the grinding apparatus during the cutting motion.

14 Claims, 12 Drawing Sheets

APPARATUS FOR CUTTING RECESSES IN PAVEMENT

Priority of Invention

This application is a continuation-in-part of United States Application Ser. No. 08/940,433 that was filed with the United States Patent and Trademark Office on Sep. 30, 1997 now abandoned.

BACKGROUND

1. Field of the Invention

The present invention is directed to an apparatus for forming depressions in the surface of the road, and in particular, to a high speed grinder for forming a series of spaced apart depressions in the pavement.

2. Prior Art

Rumble strips or sonic noise alert pattern (SNAP) depressions in the surface of the road are well known. Such depressions generate an easily heard noise when a vehicle drives over such a stretch of pavement. In addition, vibration is usually passed to the driver and passengers of the vehicle, alerting them that they have passed over such a pattern of depressions. Such SNAP depressions are often placed at the side of the road on the shoulder to alert a driver that the vehicle has veered off the driving lane and onto the shoulder, as may happen when drivers fall asleep at the wheel. In addition, rumble strips are placed within the lanes of the road to alert the driver that he/she is approaching a stop and to slow down in anticipation of the upcoming stop.

It can be appreciated that forming such depressions in the road usually requires a grinding device that must rise and full in a predetermined cycle to create a series of substantially evenly spaced apart depressions. For very hard pavement surfaces, such as concrete surfaces, the power required is substantial in order to form the depressions. The speed of forming such depressions is generally quite slow, on the order of a few hundred yards per hour. When miles of such SNAP depressions must be placed on the shoulder, the work can be a very time consuming process. In addition to the time required, the costs become substantial for a crew and the grinding equipment. Besides the costs of forming the strips, the inconvenience to the drivers using the road, including lane closures, can be substantial, causing severe traffic delays.

Prior devices for forming such strips are shown in U.S. Pat. Nos. 5,607,225, 5,391,011 and 5,484,228, to Thomas et al. These patents show a device and method for making SNAP depressions in the surface of pavement. The devices generally mount to a small skid steer loader device that has relatively little power for such an operation. In addition, the devices utilize an attachment that includes a cam type member engaging the surface of the road. Spacing of depressions and raising and lowering of the cutting head are linked directly to the movement of the cammed follower. Although the Thomas devices may provide for cutting a series of SNAP depressions, the speed at which such a device may travel is very limited due to the inadequate power available to the cutting head. Moreover, problems are encountered when the follower slips or engages other irregularities in the road surface as it directly connects to and supports the cutting head, leading to an irregular pattern of depressions.

Another device for cutting depressions in the road is shown in U.S. Pat. No. 5,297,894, to Yenick. The Yenick patent shows a pivotally mounted cutting head with a pair of guide wheels and a cam at the rear of the cutting device to raise and lower the blades. The cam includes a chain arrangement with the guide wheels to raise and lower the cutting head to the proper depth. However, the pivoting arrangement does not provide sufficient power or speed for the cutting head. The Yenick device requires the blades to follow a cam member with a wheel engaging the outer periphery of the cam. Although this eliminates the problems of a cam directly engaging the road surface, it is possible for the chain of the Yenick device to slacken or for the follower wheel to disengage the cam member, thereby leading to irregularities in the depression pattern.

It can be seen then, that a new and improved method and apparatus for cutting evenly spaced apart depressions in the surface of pavement is needed. Such a device should provide for directly lowering and raising the cutting head without use of a pavement engaging cam member and a follower. Such a device should support the cutting head and carriage from above for lowering or raising without directly engaging irregularities in the road surface from a follower wheel supporting the carriage. Such a device should provide sufficient power and direct support for raising and lowering the cutting head in a predetermined pattern at sufficient speed to cut even hard pavement material at speeds of over one mile per hour. In addition, such a device should provide for varying the length and spacing of the cuts and for easily varying cut parameters during operation. The present invention addresses these as well as other problems associated with cutting a series of depressions in the surface of the pavement.

SUMMARY OF THE INVENTION

The present invention relates to an apparatus for forming rumble strips, also known as Sonic Noise Alert Pattern (SNAP) depressions in the surface of the road. The grinding apparatus includes a support frame that supports a grinding carriage on its own movable frame. The carriage can be moved between a raised travel position and a lowered cutting position.

The carriage includes drive wheels at the rear of the carriage and a center wheel before the carriage. The carriage is supported off of two parallel transversely extending rotating shafts. The shafts include a central large diameter portion and smaller diameter end portions. The axes of the large and small diameter portions are offset so that rotation of the shafts provides eccentric motion. Therefore, the carriage, supported on the central large diameter portion, moves up and down as the shafts are rotated in parallel. This provides for an even support between the front and rear of the carriage. The arbor rises and falls with the carriage and is positioned with one support shaft in front of the arbor and the other behind. The support shafts are driven directly off the drive wheels so that changes in speed of the apparatus are reflected in the up and down motion of the carriage, thereby maintaining an evenly spaced pattern of depressions. However, the arbor is driven by a separate motor, so that cutting speed is not affected should there be increases or decreases in speed of the grinder.

The present invention also provides improved quality in the cutting pattern, as the arbor rotates with an upcut wherein the forward leading portion of the arbor relative to the grinder travel direction is rotating upward relative to the surface of the ground while the back of the cutting teeth are rotating downward into the ground. This motion is opposite the direction of the rotating carriage support shafts. The support shafts rotate so that the carriage is moving rearward relative to the grinder during the cutting portion of their travel. As the teeth disengage the ground, the arbor begins moving forward relative to the grinder apparatus. Therefore, since the grinder is moving forward, but the carriage is moving rearward relative to the grinder, there is less forward movement of the arbor relative to the ground than movement of the grinder. This prevents the teeth from being dragged forward as fast as the rate of travel of the grinder apparatus and shortens the length of the cut. However, when the arbor is raised above the ground and the carriage is moving forward as is the grinder, the carriage and cutting teeth accelerate forward while raised to a spaced apart position from the prior cut. This provides an even spacing pattern between adjacent cuts at greater speed. In addition, the spacing remains constant even if changes in the speed of the drive wheels occur and eliminates extra follower wheels.

For improved cutting and balance, the carriage includes counterweights offset from the arbor drive motor at a diametrically opposed corner of the carriage. In addition, the rotating carriage support shafts include a stack of weights that are supported about the shafts opposite of the carriage so that the power needed to raise and lower the carriage is decreased and there is better balance about the rotating shafts. The apparatus also includes separate support wheels for transporting and steering the apparatus when not cutting. The carriage forward wheel and drive wheel are spaced closer together on the support frame than the forward steering wheel and transport drive wheels so that the arbor more closely follows the contour of the ground and does not overcut or undercut in peaks and valleys. The grinder also includes height adjustment for raising or lowering either side of the carriage during operation to vary cutting depth for irregularities encountered in the pavement surface.

These features of novelty and various other advantages which characterize the invention are pointed out with particularity in the claims annexed hereto and forming a part hereof. However, for a better understanding of the invention, its advantages, and the objects obtained by its use, reference should be made to the drawings which form a further part hereof, and to the accompanying descriptive matter, in which there is illustrated and described a preferred embodiment of the invention.

BRIEF DESCRIPTION OF THE DRAWINGS

Referring now to the drawings, wherein like reference numerals and letters indicate corresponding structure throughout the several views.

DETAILED DESCRIPTION OF THE PREFERRED EMBODIMENT

Figure 1:
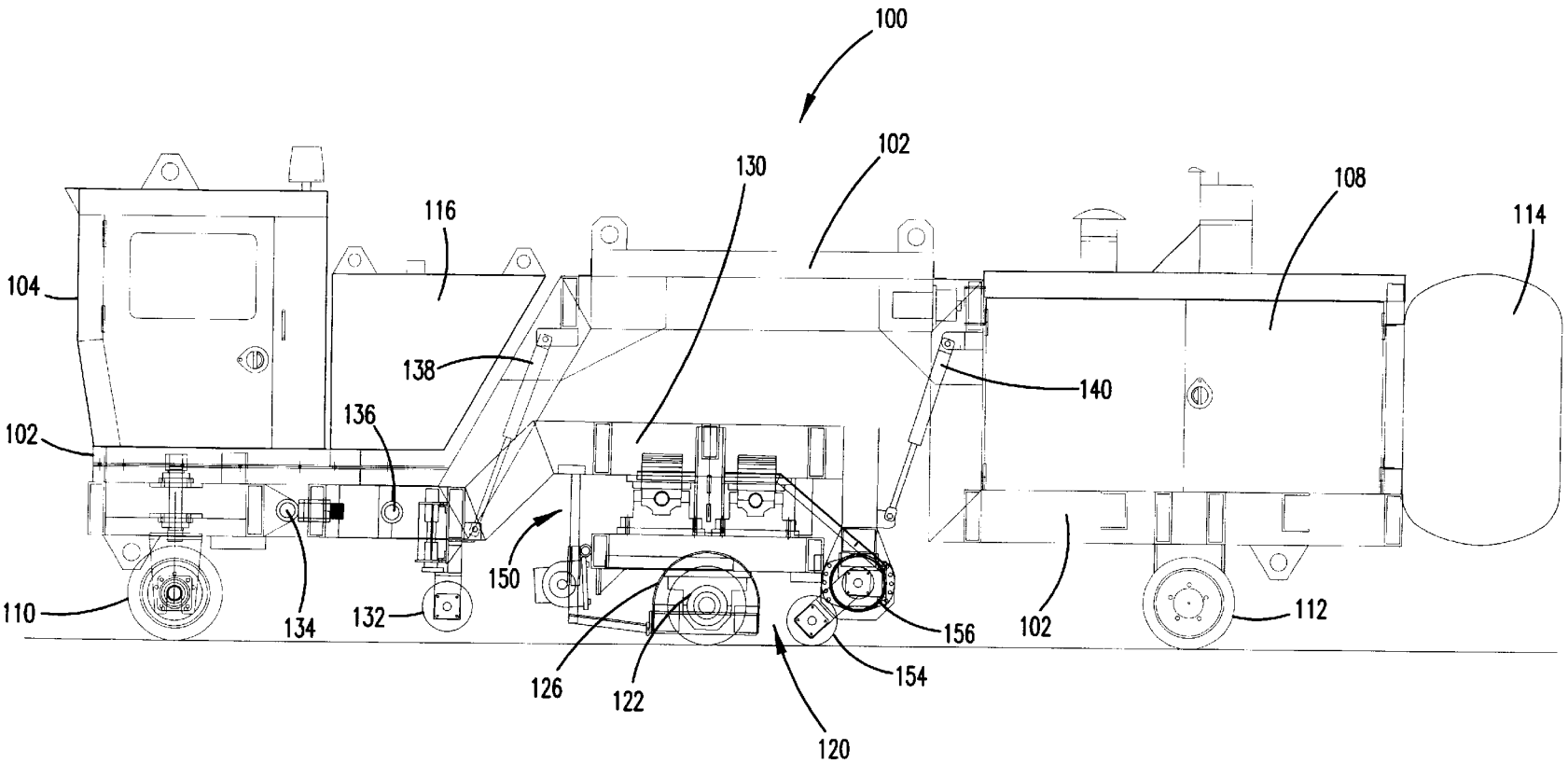
FIG. 1 shows a side elevational view of a pavement grinding apparatus according to the principles of the present invention.
Figure 2:
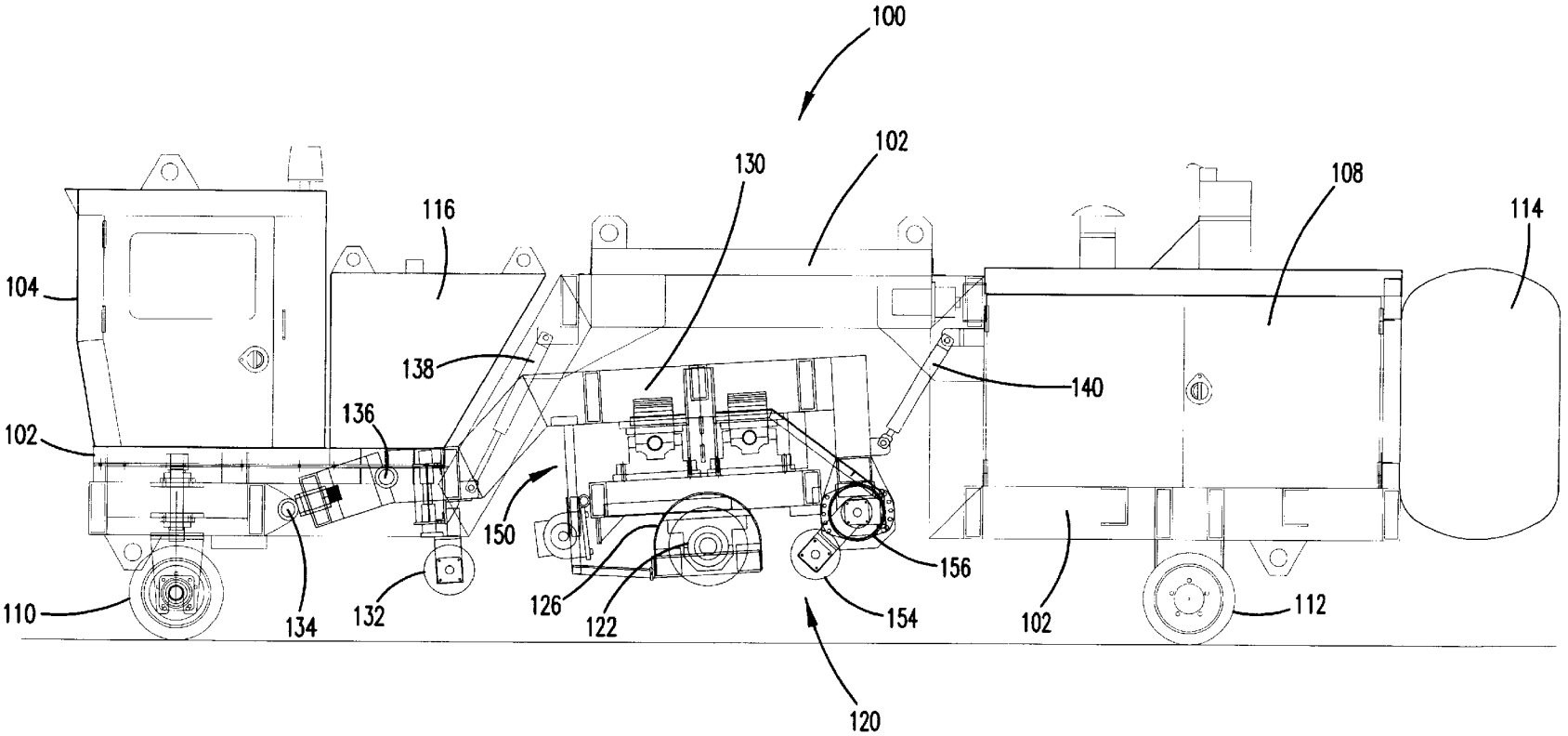
FIG. 2 shows a side elevational view of the pavement grinding apparatus of FIG. 1 with the cutting device raised for travel.
Figure 6:
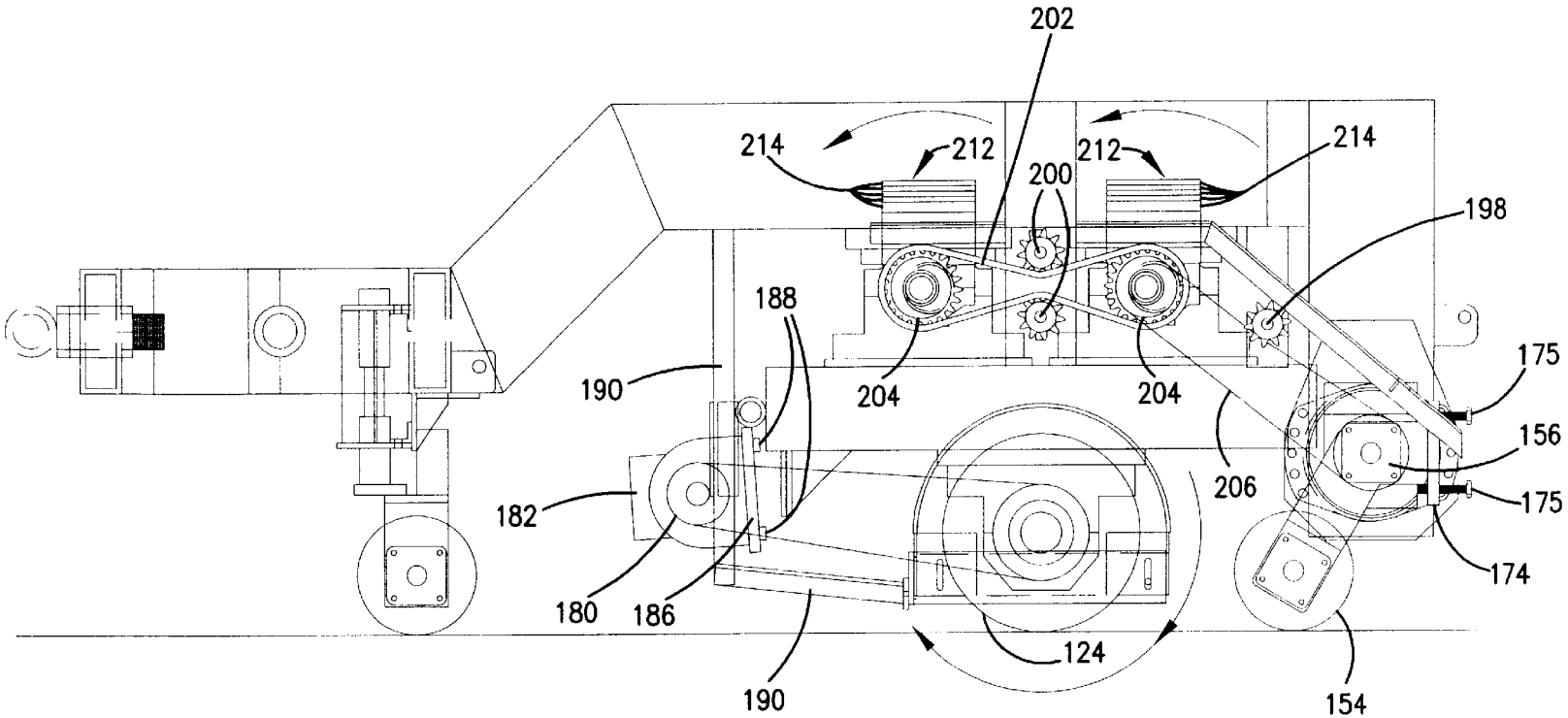
FIG. 6 shows a side elevational view of the cutting device.

Referring to the drawings, and in particular to FIGS. 1 and 2, there is shown a pavement grinder, generally designated 100. The grinder 100 includes a main frame 102 supporting a cutting device 120 having a grinding carriage 150 with an arbor 122 and as shown in FIG. 6, cutting teeth 124. A cab 104 at the front of the grinder 100 includes an access door and a seat for an operator. The cab 104 also has controls for the grinder, such as steering, speed and grinding functions. The grinder 100 is powered by an engine 108 at the rear of the grinder. The engine 108 supplies power for hydraulic motors for the drive wheels, cutting arbor and lift devices. When not grinding, steering is controlled by a front wheel 110 below the cab 104 and the grinder 100 is driven by rear wheels 112 below the engine 108. A water tank 114 supplying the water for dust control is supported off the rear of the grinder while a fuel tank 116 mounts on the frame 102 behind the cab 104 and ahead of the cutting device 120.

Figure 3:
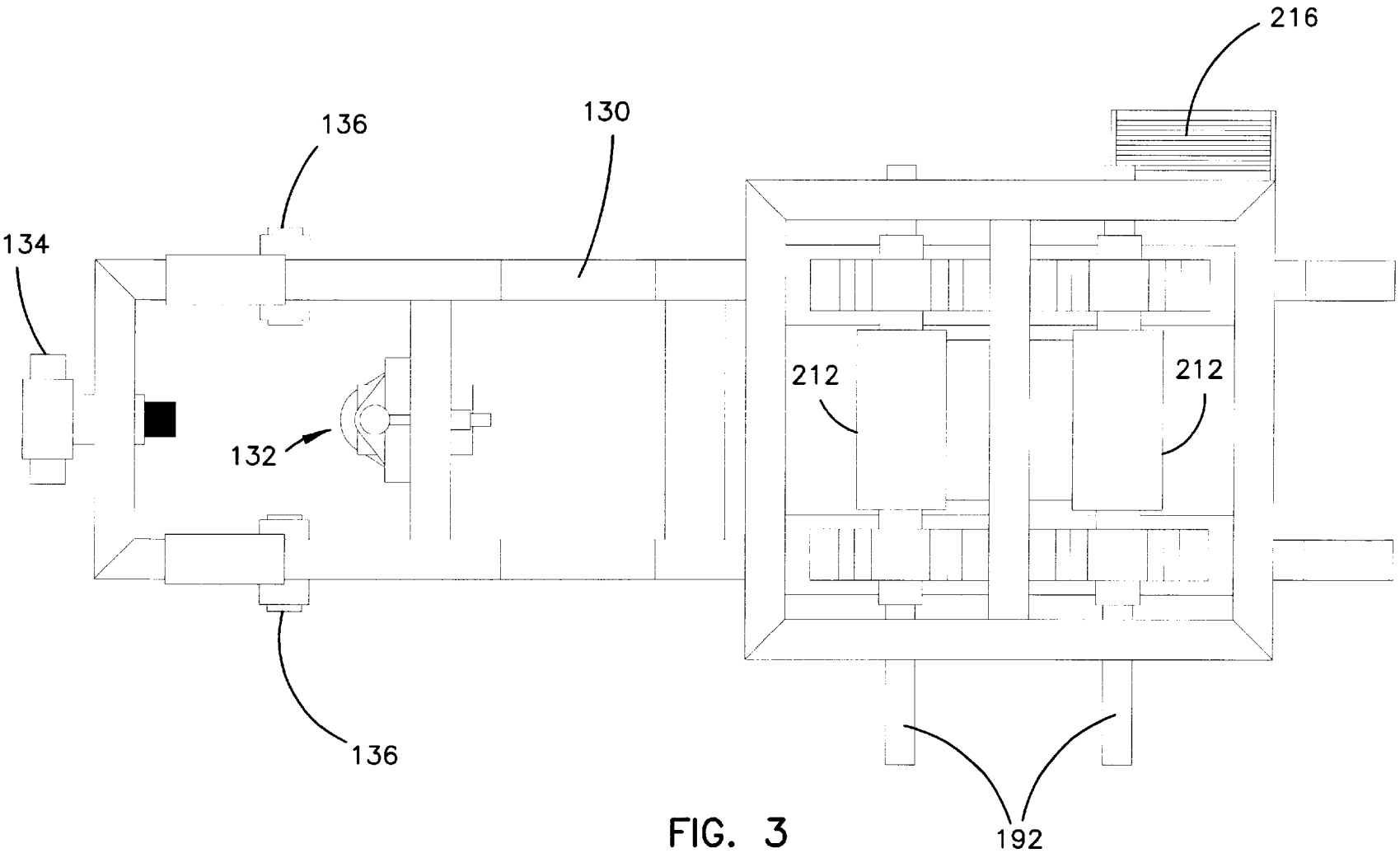
FIG. 3 shows a top plan view of the cutting device and support frame for the pavement grinding apparatus of FIG. 1.

The carriage 150 is supported on a cutting device support frame 130, as shown in FIG. 3. The grinding carriage support frame 130 pivotally mounts at the front portion to the grinder mainframe 102 below the cab 104 at a center joint 134 as shown in FIGS. 1 and 2. The carriage support frame 130 is hinged at a second joint 136 below the fuel tank 116. The two pivots 134 and 136 provide for raising and lowering the carriage 150 while maintaining the carriage 150 at a desired orientation at any height. The frame 130 forks and extends upward above the carriage 150 at its rear portion. In a first embodiment, a single forward central hydraulic cylinder 138 as well as a pair of rear hydraulic cylinders 140 provide for lifting the carriage 150 between a lowered grinding position shown in FIG. 1, and a raised transport position, shown in FIG. 2, while screw jacks 240 are utilized in a second embodiment shown in FIGS. 11 and 12. The grinding device 120 also includes a grinding carriage lead wheel 132 which is also steerable from the controls in the cab 104 by the operator and two pairs of drive wheels 154 at the rear of the carriage frame 130, used during grinding. The carriage lead wheel 132 is provided behind the transport front wheel 110. The carriage 150 is supported off the more closely spaced wheels so that the arbor 122 more closely follows the contour of the surface of the ground. The grinding device may cut too deeply when going over hills and may not cut deeply enough when passing over valleys in the pavement if the distance between the front and rear support wheels is too great. Therefore, during cutting, the grinding apparatus 100 is driven by the carriage drive wheels 154 just behind the arbor 122 and the cutting device 120 is steered and supported on the lead wheel 132 in the front of the carriage 150, but behind the front wheel 110. As the distance between the wheels 132 and 154 is substantially decreased, the amount of over cutting or under cutting is also decreased. In addition, the turns to the left and right track closer to the desired path with the shorter wheel base.

Figure 4:
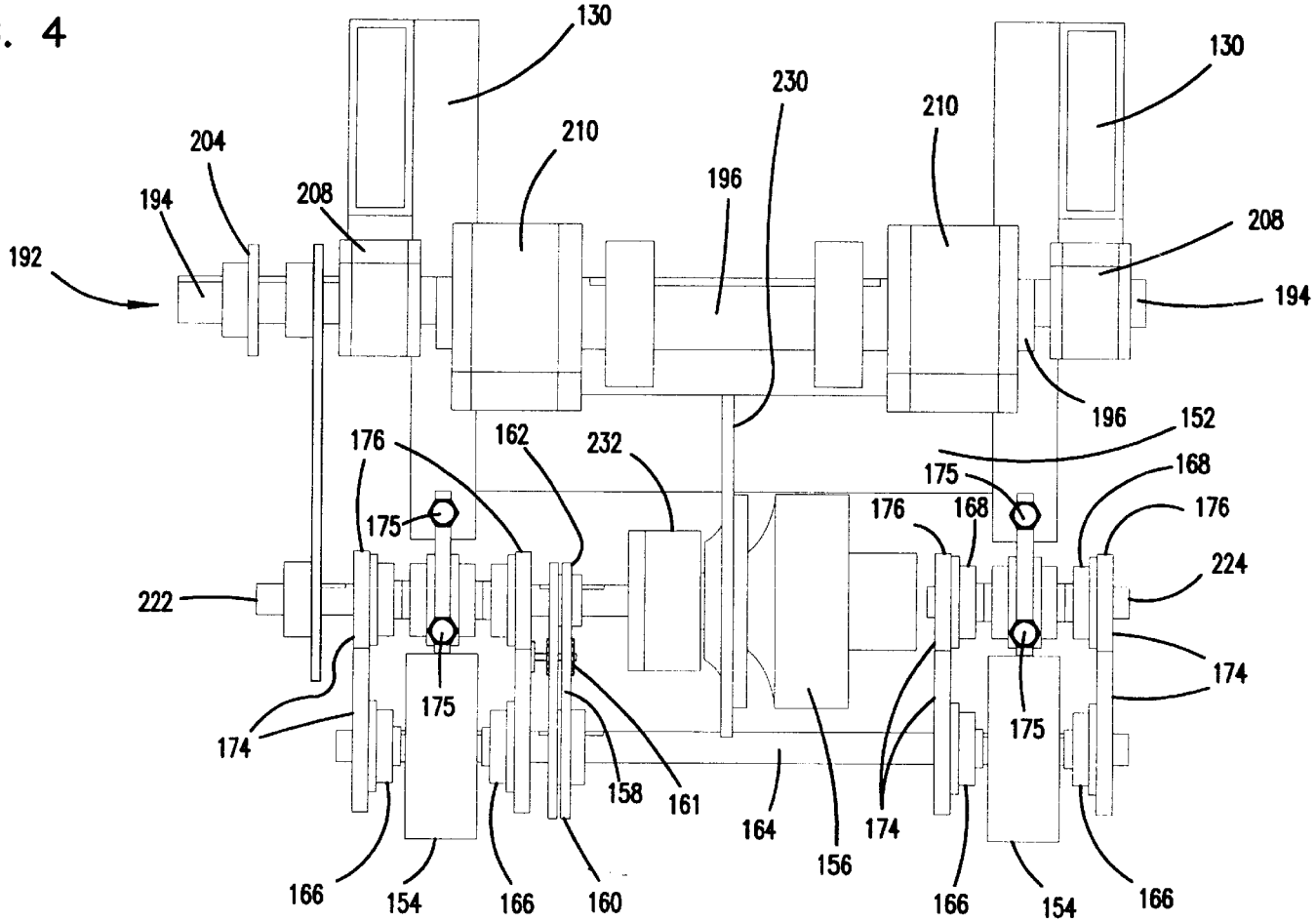
FIG. 4 shows a rear elevational view of the cutting device.

Referring to FIG. 4, when grinding, the cutting device is driven by a pair of dual wheels 154 mounted on an axle 164.

The wheels 154 are supported on a pair of mounting plates 174 extending upward to a drive motor shaft 222 and an axially aligned shaft 224. The drive wheel axle 164 is supported by bearings 166 while the shafts 222 and 224 include bearings 168 and bushings 176. A drive motor 156 is mounted on a bracket 230. A double chain 158 connects a sprocket 162 on shaft 222 to a sprocket 160 on the drive axle 164 and a tensioning sprocket 161 keeps the chain 158 tight. The motor 156 includes an adapter 232 for engaging the shaft 222. In a first embodiment, adjustment of the mounting plates 174 supported on mounting bolts 175 provides for moving the drive wheels 154 vertically relative to the carriage 150, and thereby controls the elevation of the cutting device 120 and the corresponding depth of the cut that is made.

Figure 5:
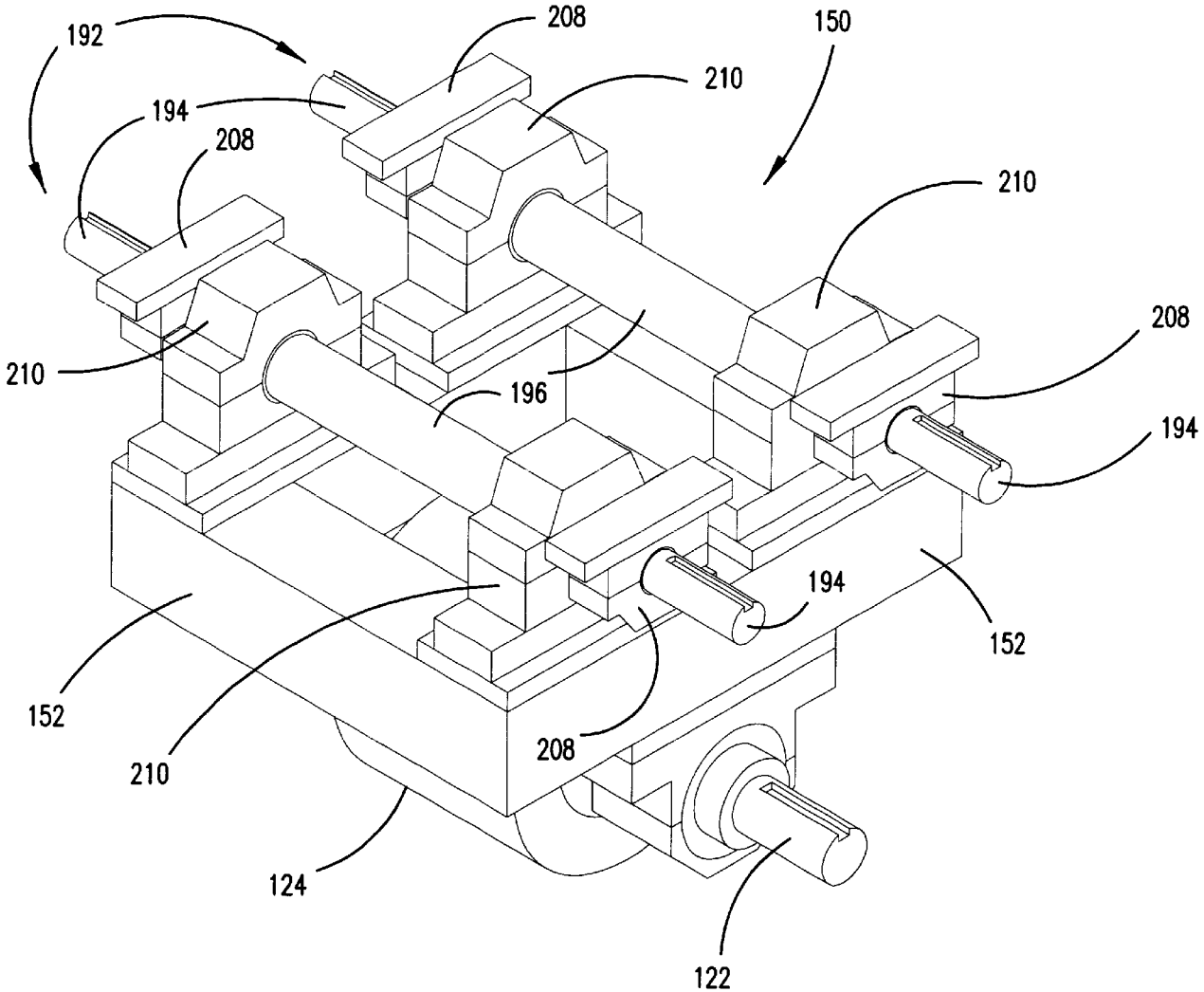
FIG. 5 shows a prospective view of the cutting device grinding carriage.

As shown in FIG. 1, the grinding carriage 150 is supported on the frame 130, and shown in FIGS. 4–5 by eccentric shafts 192. Bearings 208 support the shafts at the outer end from the cutting device frame 130 while the carriage 150 includes bearings 210 mounting to the shafts 192 inside of the bearings 208. It can further be appreciated that the carriage 150 includes a framework 152 supporting the arbor 122 as well as the cutting teeth 124.

The shafts 192 are eccentric shafts with a smaller diameter portion 194 at the ends while a center portion 196 extends through the bearings 210 of the carriage 150 shown in FIGS. 1–2. As shown in FIGS. 4–5, as the rotational axes are offset between the different diameter portions 194 and 196, as the shafts 192 rotate, the center larger portion 196 is offset from the end smaller diameter portion 194. Therefore, the central portions 196 rise and fall as the shafts 192 rotate. As the carriage 150 is supported from the center larger diameter portions of the shafts 196, the carriage 150 and the arbor 122 rise and fall. Therefore, a pattern of spaced apart depressions in the pavement is created as the grinder 100 advances.

The arbor 122 is driven by a motor 180 supported on a mounting plate 186. An overhung load adapter li2 provides for adapting the motor 180 to drive the arbor 122. Adjustment bolts 188 provide for proper tension and positioning of the arbor motor and associated chain. A support bracket 190 extends upward and rearward. The bracket 190 connects to a material shroud 126 extending around the arbor 122 and cutting teeth 124. The shroud 126 may also include spray nozzles and a vacuum system for controlling dust and removing debris created by the grinding operation, as is well known in the art. The weight of the carriage moving up and down creates a torque about the shafts 192. To offset the torque and associated stresses, counterweights 212 mount on the larger diameter inner portion 196 of the shafts 192. The counterweights 212 are a stackable number of individual plates 214 so that weight can be added and removed, depending upon the weight of the carriage 150 and other operating conditions. The counterweights 212 provide balance about the shafts and reduce the power needed to raise and lower the carriage 150. In addition, as shown in FIG. 3, the arbor motor 180 mounts on the left side of the carriage 150. This also creates an imbalance as the arbor 122 is driven from the left. To offset the weight and torque, counterweights 216 are placed on the right side of the cutting device 120 and at the rear. The counterweights 216 provide balance and reduce moments created by the cutting device's various transverse shafts rotating.

The shafts 192 are driven by the motor 156, so that rotational speed of the shafts 192 is proportional to the speed of the drive wheels 154. A chain 206 is driven by the motor 156 and drives the rear shaft 192. A tensioning sprocket 198 engages the chain 206 to prevent slack and maintain tension. So that the carriage has an even motion and to ensure that the shafts 192 remain synchronized, sprockets 204 mounting to the shafts are connected by a timing chain 202, as shown in FIG. 6. Tensioning sprockets 200 are mounted on slots and ensure proper tension in the chain so that synchronization is maintained between the two carriage support shafts 192. The synchronization of the shafts 192 maintains the carriage 150 at a level orientation and also maintains constant height and depth to the carriage's motion.

According to the present invention, the arbor 122 executes an upper cut, rotating in a clockwise motion as viewed in FIGS. 7–10. In this manner, the cutting teeth 124 contact the ground at the trailing edge relative to the direction of travel of the apparatus 100, and rotating forward and upward away from the ground at the leading edge with the shroud 126 behind the arbor 122 as the grinder 100 travels. It can further be appreciated that the arbor 122 rotates in a first direction, but the carriage 150 moves in the opposite direction. Therefore, an upper cut 124 is achieved, providing improved cutting and grinding with depressions formed having smoother edges and cleaner cuts. An upper cut throws debris forward, making cleanup easier as most debris is picked up by the vacuum system.

Figure 7:
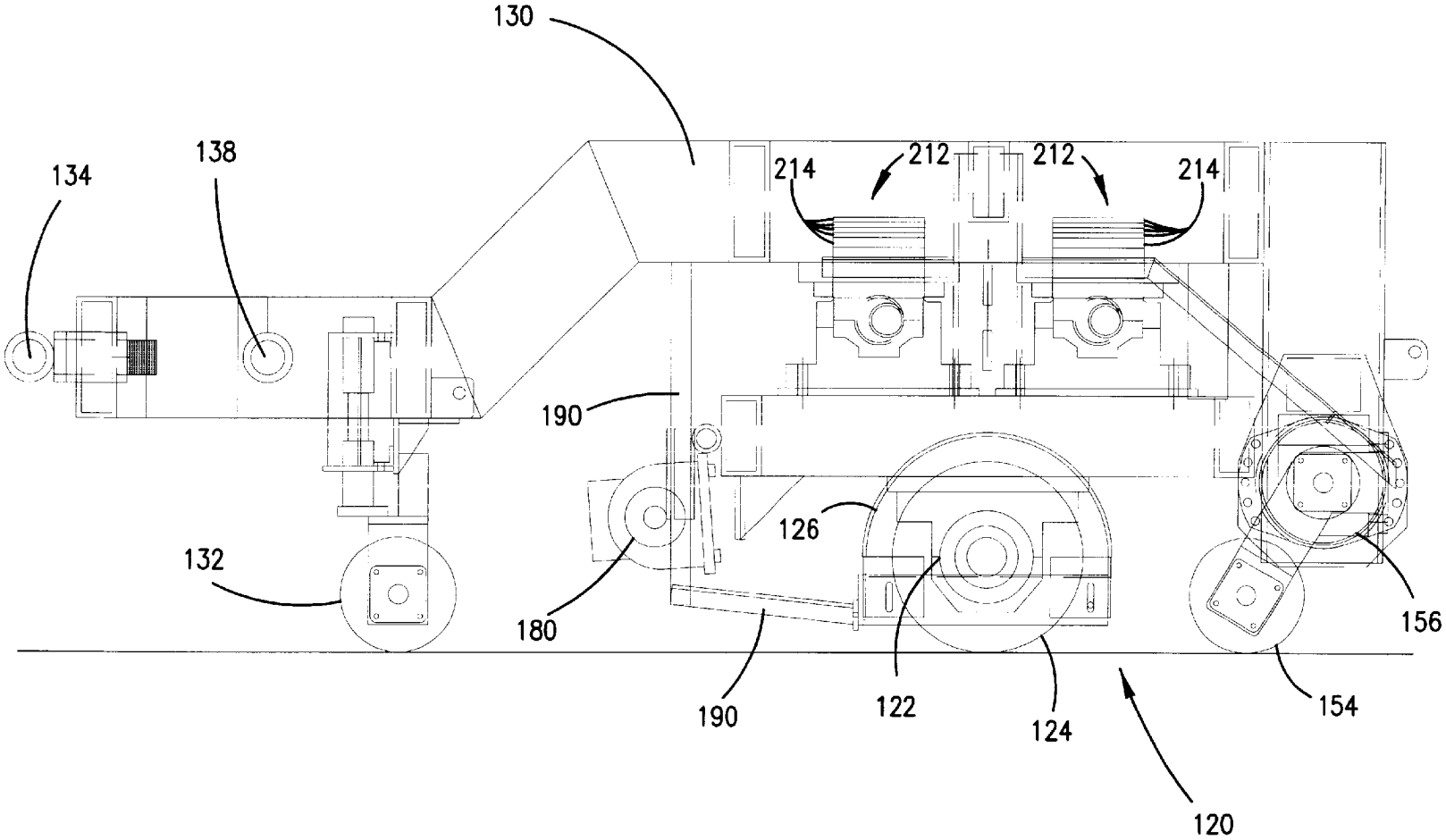
FIG. 7 shows a side partial sectional view of the cutting device during the beginning of a cut.
Figure 8:
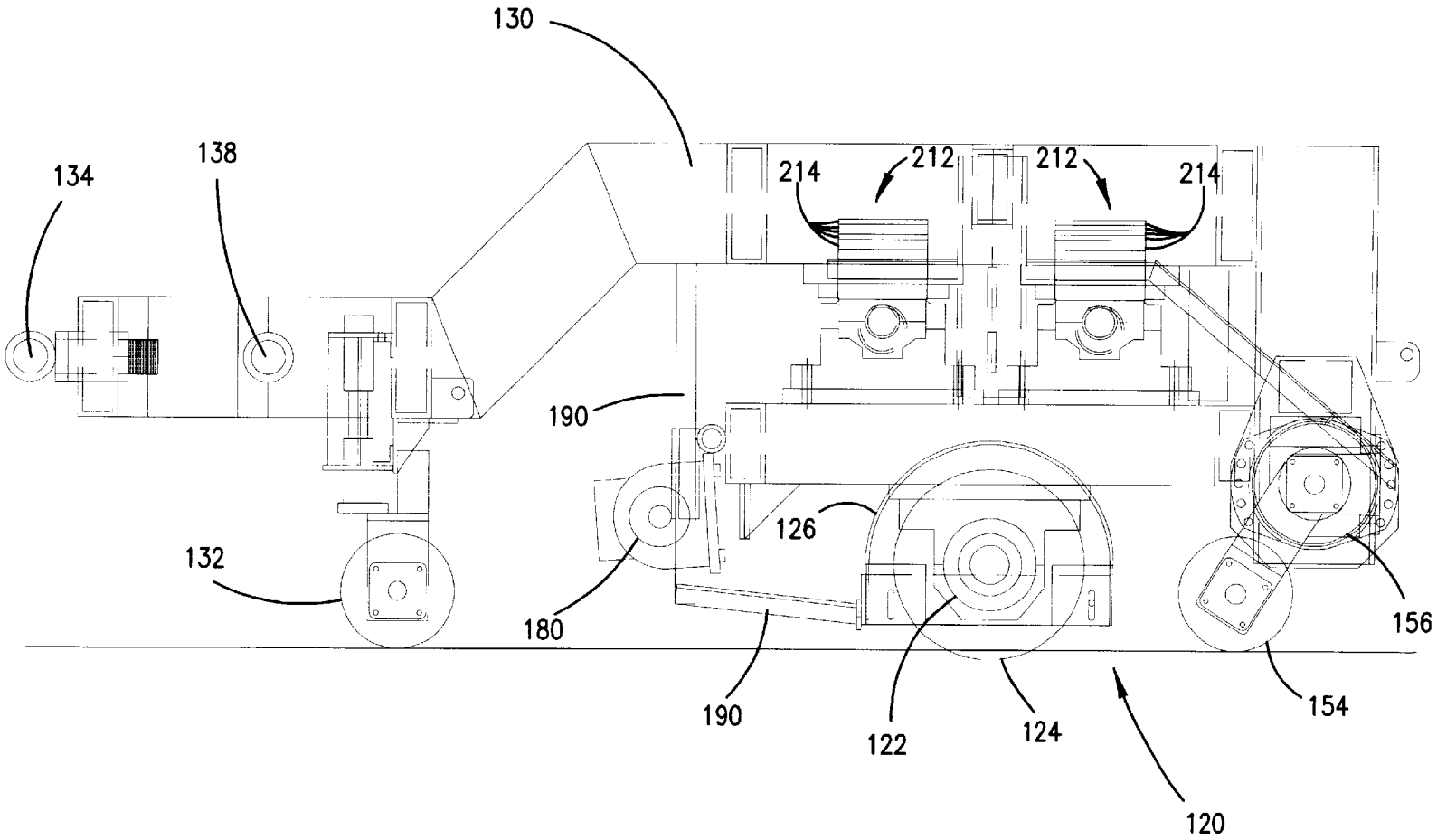
FIG. 8 shows a side partial sectional view of the cutting device during the low point of a cut.
Figure 9:
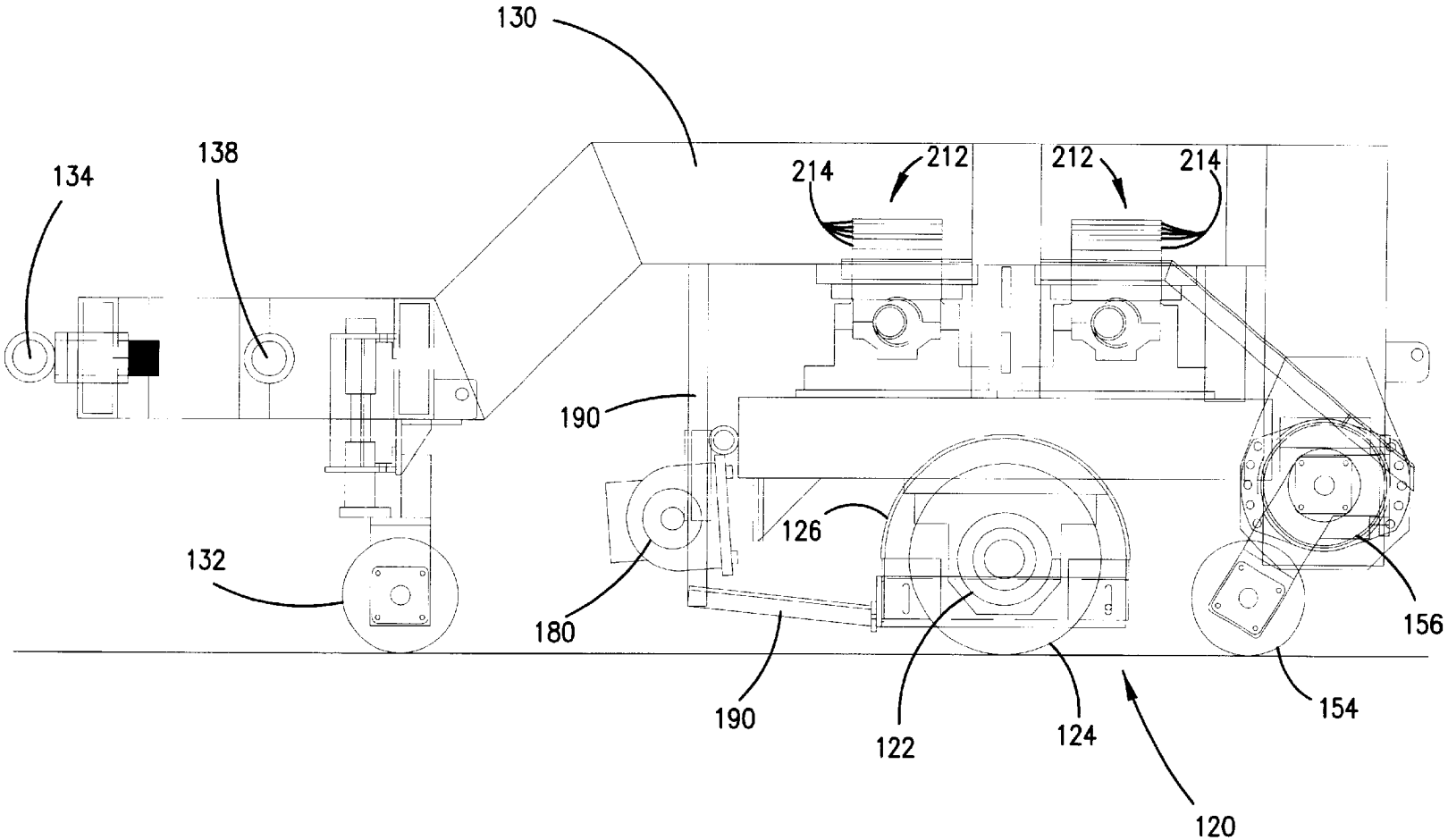
FIG. 9 shows a side partial sectional view of the cutting device during the end of a cut.

As shown in FIG. 7, at the forward most position, the carriage 150 is at the midpoint of its travel from the highest to lowest position, as the eccentric large diameter shaft 196 is at its forward most position and the counterweights 212 extend to the rear. Therefore, as the teeth 124 move further downward, they also move rearward. As the grinder 100 is moving forward, the arbor cutting teeth 124 move rearward relative to the grinder 100. By changing the ratios of the drive wheels 154 and/or their associated sprocket, the sprocket for the motor 156 and the sprockets 204, the arbor 122 may be dragged slightly forward, may be substantially stationary relative to the pavement, or may actually move slightly rearward during the cut. As shown in FIG. 8, at the low point of the cut, the large diameter shaft 196 is directed downward while the counterweights 212 are directed vertically upward. The shaft 196 is moving entirely rearward from this point, relative to the grinder 100 against the forward travel direction of the grinder 100. At this lowest point, the arbor 122 and the cutting teeth 124 are about to start rising and the cut has reached its greatest depth. The carriage 150 is maintained in a horizontal position with the support shafts 192 remaining horizontally parallel to one another. As shown in FIG. 9, at the rearward most point of travel of the carriage 150, the large diameter portions of the shafts 196 are directed rearward while the counterweights 212 extend forward. The arbor 122 and the teeth 124 are moving upward at this point and disengaging the pavement and the surface of the ground. The shafts 196 as well as the carriage 150 and the arbor 122 are about to start moving forward.

Figure 10:
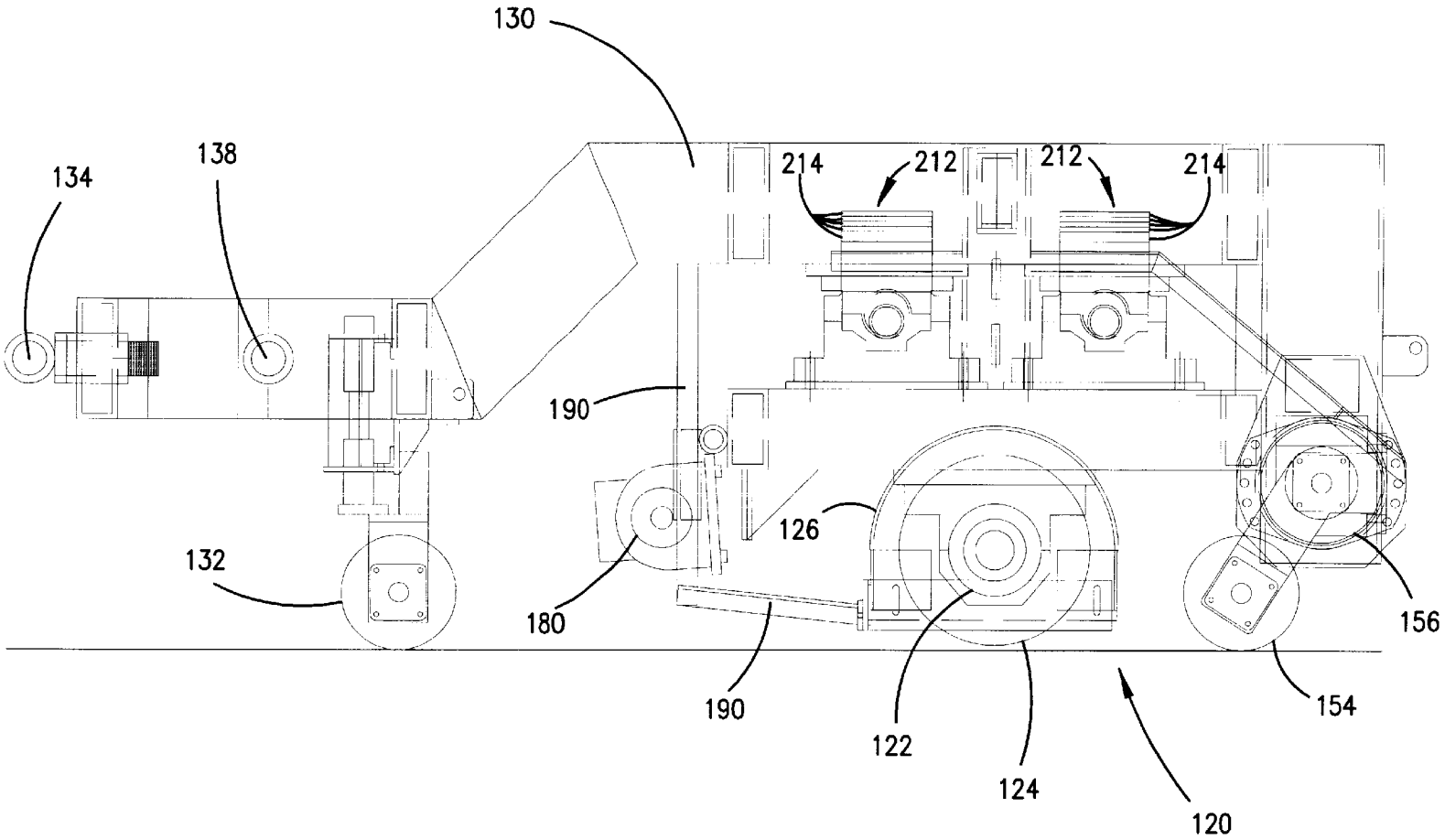
FIG. 10 shows a side partial sectional view of the cutting device following the end of a cut and prior to the beginning of a next cut.

As shown in FIG. 10, as the eccentric shafts 196 reach their apex, the teeth 124 are clear of the ground. The counterweights 212 extend downward and offset the rise of the carriage 150. It can also be appreciated that as the grinding apparatus 100 is moving forward and the eccentric shafts and the carriage 150 are also moving forward, as the arbor 122 starts its forward motion, it is accelerated forward relative to the ground and the next contact with the ground is made at a spaced apart location from the prior cut. The forward speed of the carriage 150 and the arbor 122 relative to the ground is opposite to and/or substantially greater during the upper leg of travel than during the lowered leg, wherein the carriage 150 is moving rearward relative to the grinder 100.

Figure 11:
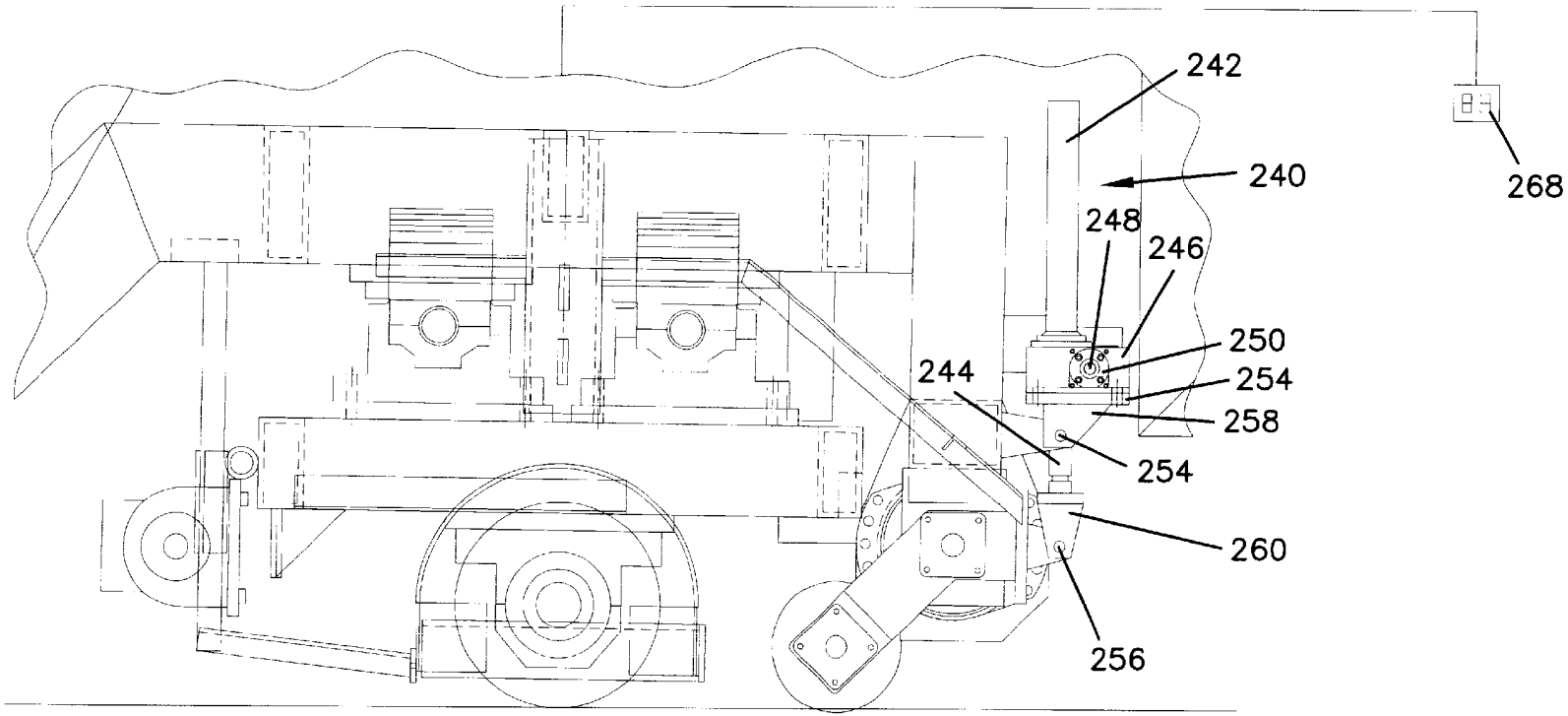
FIG. 11 shows a side elevational view of a second embodiment of the present invention having automatic depth adjustment controls.
Figure 12:
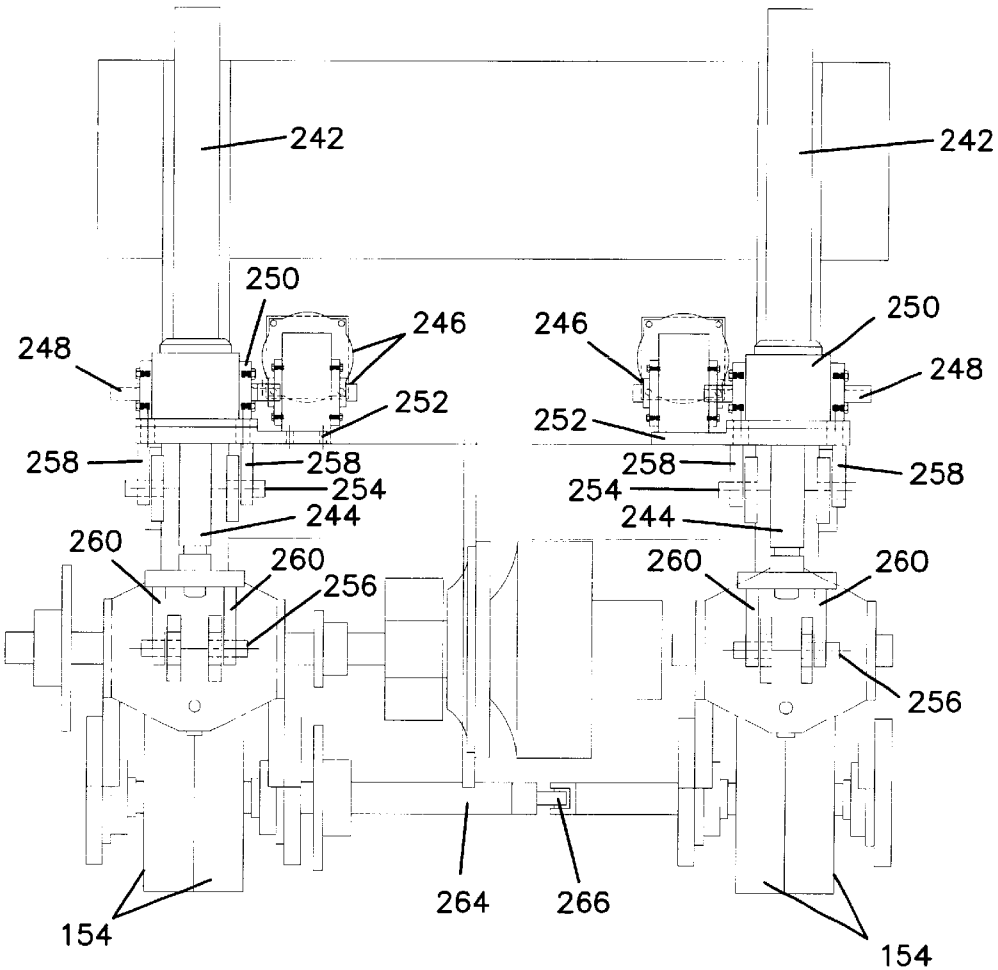
FIG. 12 shows a rear elevational view of the grinding carriage shown in FIG. 11.

In a second embodiment, as shown in FIGS. 11 and 12, the carriage 150 may include screw jacks 240 for adjusting the cutting depth. These screw jacks 240 include an upper housing 242 and a lower telescoping portion 244, that can be extended and retracted. A separate hydraulic motor 246 powers each of the screw jacks 240, with a horizontal shaft 248 and adapter 250 connecting the associated hydraulic motors 246 to the screw jack 240. The horizontal shaft 248 includes complimentary teeth engaging the screw portion of the screw jacks 240 to raise and lower the screw jack 240 as the shaft 248 rotates. The screw jacks 240, adapter 250 and motors 246 mount with plates 252 to the carriage 150. Bolts 254 and 256 further secure the screw jacks 240 to brackets 258 and 260 on the carriage 150. As the extendible portion 244 extends and retracts, the position of the wheels 154 relative to the carriage 150 is varied. Pivoting occurs about the axis to the drive motor 156, providing a deeper or shallower cut.

As shown in FIG. 12, the drive wheels 154 may include an axle 264 having a universal joint 266 intermediate the drive wheels 154. The screw jacks 240 may be operated independently so that the depth of each of the sets of drive wheels 154 may be adjusted independently of one another. This provides for raising or lowering each side of the arbor 122 to increase or decrease the depth of the cut at each side rather than merely raising and lowering the overall depth of the cut. This flexibility provides for more closely following the slope and contour of the pavement over which the grinder 100 is traveling. A universal joint 266 provides for drive to each set of wheels 154 without undue binding or other problems no matter what elevation each end of the arbor 122 is at.

With the present invention, the depth may be adjusted during operation without stopping. A switch 268 is mounted at the rear of the grinder 100 at one side of the housing for the engine 108. At this position, an operator may walk safely alongside the grinder 100 and view the cuts and pavement contour to make the necessary adjustments without stopping the grinding operation. The switch 268 provides for raising or lowering each of the screw jacks 240 independently of one another to provide for raising or lowering the overall depth as well as raising and lowering each set of drive wheels 154 to vary the depth at the left and right ends of the arbor 122. This provides for greater control to match the contour of the pavement surface for improved quality of the SNAPs that are formed. The switch 268 also provides for safer adjustment without the use of any tools and with the operator positioned safely behind and away from the rotating devices of the grinder 100.

With the present invention, as the carriage 150 is supported from above, irregularities in the pavement surface are less likely to affect the type of cut than grinders having a cam wheel engaging the ground immediately before the arbor. The carriage support shafts 192 are driven off the rear drive wheels 154 so that proper spacing is maintained. As the grinder 100 slows or speeds up, the speed of the carriage's motion speeds or slows proportionally. However, the rotational speed of the arbor 122 is always maintained so that sufficient cutting velocity is maintained, whether the grinder 100 is moving slowly or more quickly. The speed of the cut and forces may be optimized to match the different types of surface and terrain which are encountered. Spacing and relative speeds can easily be varied by changing the ratios of the various sprockets and pulleys. Moreover, as the arbor 122 is executing an uppercut and throwing material forward, there is less debris spread about that is not recovered, as well as a cleaner cut.

It is to be understood, however, that even though numerous characteristics and advantages of the present invention have been set forth in the foregoing description, together with details of the structure and function of the invention, the disclosure is illustrative only, and the changes may be made in detail, especially in matters of shape, size and arrangement of parts within the principles of the invention to the full extent indicated by the broad general meaning of the terms in which the appended claims are expressed.

What is claimed is:

1. A pavement grinding apparatus, comprising:

a cutting device having a grinding carriage with carriage wheels, and a rotating arbor hanging from underneath the carriage;

a support device for supporting the grinding carriage from above; and a pair of horizontal parallel rotating support shafts above the grinding carriage and arbor, wherein each support shaft has an offset connector portion for imparting a cyclical up and down movement to the cutting device from above the arbor;

a first motor driving the arbor in a first direction and a second motor driving the carriage wheels and the rotating support shafts in a second opposite direction; wherein the carriage wheels remain in contact with the pavement when the grinding carriage is in a raised position.

2. An apparatus according to claim 1, wherein the cutting device moves backward relative to the grinding apparatus during the cutting motion.

3. An apparatus according to claim 1, further comprising an independent depth controller.

4. An apparatus according to claim 3 wherein the independent depth controller is remotely actuatable from a position rear of the arbor.

5. An apparatus according to claim 1, further comprising a depth controller actuatable during operation.

6. A pavement grinding apparatus, comprising:

a frame;

a rotating arbor;

a grinding carriage including drive wheels, wherein the arbor is hung from underneath the grinding carriage;

a support device including rotating shafts for hanging the grinding carriage from the frame and for imparting a cyclical up and down movement to the grinding carriage and moving the grinding carriage backward relative to the grinding apparatus during cutting;

wherein the rotating shafts are driven from the drive wheels and wherein the drive wheels remain in contact with the pavement when the grinding carriage is in a raised position.

7. An apparatus according to claim 6, wherein the support device comprises a pair of parallel eccentric shafts extending over the carriage, wherein each shaft has an offset end portion.

8. An apparatus according to claim 6, further comprising a first motor driving the arbor.

9. An apparatus according to claim 8, further comprising a second motor driving the grinding carriage.

10. An apparatus according to claim 6, wherein the grinding carriage moves backward relative to a direction of travel during cutting of the pavement.

11. An apparatus according to claim 6, wherein the support device comprises a pair of eccentric shafts, wherein each shaft has a center portion and offset end portions, wherein the center portion has a larger diameter than the end portions.

12. An apparatus according to claim 11, wherein the eccentric shafts extend over the carriage.

13. A pavement grinding apparatus, comprising:

a cutting device having a grinding carriage with an arbor and carriage drive wheels with a carriage wheel axle having a universal joint intermediate the wheels;

a support device for supporting the grinding carriage and for imparting a cyclical up and down movement to the grinding carriage and moving the grinding carriage backward relative to the grinding apparatus during cutting; and depth control means positioned rear of the arbor for raising and lowering the grinding carriage relative to the drive wheels.

14. An apparatus according to claim 13, wherein the depth control means comprises a first depth controller for controlling the height of a left carriage wheel relative to the carriage and a second depth controller for controlling the height of a right carriage wheel relative to the carriage.

* * * * *

UNITED STATES PATENT AND TRADEMARK OFFICE

CERTIFICATE OF CORRECTION

PATENT NO. : 6,499,809 B1
DATED : December 31, 2002
INVENTOR(S) : O'Konek

It is certified that error appears in the above-identified patent and that said Letters Patent is hereby corrected as shown below:

Column 5,
Line 38, "li2" should read -- 182 --

Signed and Sealed this

Twenty-second Day of July, 2003

JAMES E. ROGAN
*Director of the United States Patent and Trademark Office*